US006564739B2

(12) United States Patent
Doetsch

(10) Patent No.: US 6,564,739 B2
(45) Date of Patent: May 20, 2003

(54) MARINE STEERING SYSTEM HAVING DUAL HYDRAULIC AND ELECTRONIC OUTPUT

(75) Inventor: Peter Doetsch, North Vancouver (CA)

(73) Assignee: Jastram Engineering Ltd., North Vancouver (CA)

( * ) Notice: Subject to any disclaimer, the term of this patent is extended or adjusted under 35 U.S.C. 154(b) by 113 days.

(21) Appl. No.: 09/931,745

(22) Filed: Aug. 20, 2001

(65) Prior Publication Data

US 2003/0033969 A1 Feb. 20, 2003

(30) Foreign Application Priority Data

Jul. 13, 2001 (CA) ..... 2353053

(51) Int. Cl.[7] ..... B63H 25/00
(52) U.S. Cl. ..... 114/150
(58) Field of Search ..... 114/150, 144 R, 114/144, 144 RE, 144 A; 417/269, 490; 92/57, 71, 135

(56) References Cited

U.S. PATENT DOCUMENTS 2,479,063 A 8/1949 Forsythe ..... 114/150
4,004,537 A 1/1977 Nilsson ..... 114/144 R
4,736,811 A 4/1988 Marsden et al. ..... 180/133
5,107,424 A 4/1992 Bird et al. ..... 364/424.01
5,146,745 A 9/1992 Doetsch ..... 60/403
5,289,756 A 3/1994 Kobelt ..... 91/368
6,273,771 B1 * 8/2001 Buckley et al.
6,345,674 B1 * 2/2002 Easton

* cited by examiner

*Primary Examiner*—Ed Swinehart
(74) *Attorney, Agent, or Firm*—Oyen Wiggs Green & Mutala

(57) ABSTRACT

A marine steering system operable in either power steering or manual hydraulic modes. The system employs a modified helm pump having a single rotatable input shaft connectable to a steering wheel and dual hydraulic and electronic output. An encoder, such as an optical incremental encoder or hall effect device, is mechanically coupled to the input shaft for generating an electronic steering control signal representative of the change in position of the steering wheel. In the power steering mode, the electronic steering signal is processed by an amplifier controlling the operation of an auxiliary pumpset connected to the rudder steering cylinder. A bypass manifold disposed between the helm pump and the steering cylinder disables the hydraulic steering system in the power steering mode. In the event of power failure, the bypass manifold valves are opened and the system automatically switches to manual hydraulic steering.

25 Claims, 11 Drawing Sheets

MARINE STEERING SYSTEM HAVING DUAL HYDRAULIC AND ELECTRONIC OUTPUT

FIELD OF THE INVENTION

This application relates to a steering system for marine vessels employing a modified helm pump having a rotary encoder mechanically coupled to its input shaft. The system is operable in either power steering or manual hydraulic steering modes.

BACKGROUND OF THE INVENTION

Many small marine vessels, such as fishing boats, have manual hydraulic rather than power steering. Such vessels are controlled by rotating a steering wheel which causes delivery of hydraulic fluid from a helm pump directly to one or more steering cylinders which control the position of the vessel's rudder. The disadvantages of manual steering are well recognized. For example, the steering wheel must typically be rotated a large number of revolutions in order to change the direction of the vessel. Generally speaking, the larger the vessel, the more effort is required to steer manually.

Other steering problems may arise in large marine vessels such as tankers (which typically include power steering systems). The primary problem is that it is not possible to effectively steer such vessels from the wheelhouse if the power system fails. Rather, the pilot must instruct remote operators in the steering gear flat or compartment to manually alter the position of the steering cylinders. If this back-up voice communication system fails, or if the pilot's instructions are misunderstood or misinterpreted, safe control of the vessel may be lost.

Steering systems are known in the prior art having a primary electric control and a hydraulic back-up control. U.S. Pat. No. 4,736,811, Marsden et al., dated Apr. 12, 1988 relates to a steering system primarily designed for large earth moving construction and industrial vehicles rather than watercraft and hence it does not employ a helm pump. The steering system includes a steering wheel having a rotatable shaft coupled thereto. A sensor is provided for detecting the angular velocity of the shaft and directing an electrical signal to a control box. The control box, in turn, directs an electrical signal commensurate to the input signal from the sensor to energize a solenoid actuated pilot valve which in turn actuates the hydraulic steering system. The hydraulic steering circuit is disabled when the electrically controlled circuit is activated.

Since the Marsden et al. steering control system relates to land vehicles, a time delay between rotation of the steering wheel and adjustment of the steering control actuator is not permissible. Accordingly, in the Marsden et al. system a main pilot operated steering valve is provided for ensuring full flow of pressurized fluid to a steering piston in both the electric and hydraulic modes. The position of the steering wheel thus corresponds to an absolute steering position in both modes.

The Applicant has previously developed a steering signal conversion manifold specifically designed for watercraft for converting a manual hydraulic steering signal into a proportional electrical signal. The Applicant's conversion manifold is the subject of U.S. Pat. No. 5,146,745, the text and drawings of which are incorporated herein by reference. The manifold is connectable between a hydraulic fluid supply, such as a conventional helm pump, and a hydraulic steering cylinder controlling the operation of a steering tiller. The manifold includes a rotary actuator responsive to variations in flow of hydraulic fluid from the helm pump. In particular, the rotary actuator comprises a rotor shaft having a potentiometer mounted at one end thereof. In operation, when the steering wheel is turned in the power steering mode, hydraulic fluid is diverted from the helm pump into the manifold resulting in rotation of the manifold rotor shaft. This in turn causes the potentiometer to generate an electrical signal representative of the change in position of the rotary actuator and hence proportional to the manual hydraulic steering signal. In alternative embodiments of the invention, signal generating devices other than a potentiometer may be used for generating a proportional electrical signal, such as a hall effect device or an optical encoder.

While the steering signal conversion manifold of the '745 Patent is useful for its intended purpose and has exhibited commercial success, the Applicant has recognized that the same benefits may be achieved by other means. In the present invention, means for generating an electronic signal are coupled directly to the helm pump input shaft upstream from the hydraulic fluid supply lines. The signal generating means may comprise, for example, an optical encoder which generates signals responsive to rotation of the input shaft as the steering wheel is rotated. This arrangement is more versatile than the prior art system since the electronic signals generated do not necessarily correlate with absolute steering positions. Further, since the signal generating device is coupled directly to the pump input shaft, there is no time delay initiating the steering commands in the power steering mode.

Electric helms are known in the prior art which resemble a standard helm pump. However, when the steering wheel is turned a potentiometer sends an electrical signal to an amplifier controlling a power unit rather than pumping hydraulic fluid from the helm. No hydraulic back-up system is available in the event of power failure.

The need has arisen for a modified helm pump having a standard input shaft and dual hydraulic and electronic output. The invention may be conveniently retrofitted into existing vessels to provide power steering, and may also be readily installed in larger vessels to provide back-up, emergency manual steering.

SUMMARY OF THE INVENTION

In accordance with the invention, a marine helm pump assembly is provided comprising a helm pump for actuating the flow of hydraulic fluid and a first signal generator mounted on the helm pump. The helm pump includes a chamber for holding a supply of the hydraulic fluid; a single rotatable input shaft connectable to a steering wheel; and first and second fluid ports in communication with the chamber for enabling flow of the hydraulic fluid into and out of the helm pump in response to changes in position of the input shaft. The first signal generator is mounted on the helm pump and is operatively coupled to the input shaft for producing digital steering signals representative of changes in position of the input shaft.

Preferably the first signal generator is connected to the input shaft by means of a direct mechanical connection. For example, the signal generator may be mounted directly on the input shaft or may be coupled to the input shaft by means of a spur gear or belt connector. The signal generator may comprise, for example, an incremental optical encoder. Alternatively, a hall effect device or potentiometer may be employed. The assembly may further include a second signal generator also coupled to the input shaft in a similar manner for redundancy purposes.

A steering system for a marine vessel is also described enabling both electric power and manual hydraulic steering. The system includes a helm pump having a primary hydraulic fluid supply and a rotatable input shaft, the input shaft being connectable to a steering actuator, such as a steering wheel. In response to changes in position of the input shaft the helm pump pumps hydraulic fluid from the primary hydraulic fluid supply into hydraulic fluid supply lines connectable to a hydraulic steering cylinder for controlling the position of the vessel's rudder. A first signal generator is mounted on the helm pump and is operatively coupled to the input shaft for producing digital steering signals representative of changes in position of the input shaft.

Preferably the steering system further comprises a bypass manifold in fluid communication with the helm pump and the steering cylinder and located therebetween. The bypass manifold is adjustable between a first position permitting flow of hydraulic fluid between the helm pump and the steering cylinder and a second position blocking flow of hydraulic fluid between the helm pump and the steering cylinder.

The system may further include a programmable controller connectable to an electric power source and adjustable between energized and deenergized states, the controller receiving input from the signal generator in the energized state. A pumpset having a secondary hydraulic fluid supply is also provided which is connectable to the steering cylinder. The pumpset is adjustable between a third position enabling flow of hydraulic fluid between the pumpset and the steering cylinder and a fourth position blocking flow of hydraulic fluid between the pumpset and the steering cylinder. In the energized state the controller maintains the bypass manifold in the second position and the pumpset in the third position to enable power steering of the vessel. In the energized state the controller transmits control signals to the pumpset responsive to the digital steering signals received from the signal generating device. In the deenergized state the bypass manifold is automatically adjusted to the first position and the pumpset is automatically adjusted to the fourth position to enable manual hydraulic steering of the vessel.

In one embodiment of the invention the bypass manifold comprises:

(a) at least one inlet port for receiving hydraulic fluid from the helm pump;

(b) at least one outlet port for enabling delivery of hydraulic fluid from the manifold to the steering cylinder;

(c) a first conduit connecting the inlet port and the outlet port; and (d) a first diverter for selectively diverting hydraulic fluid from the first conduit to the second conduit when the manifold is in the second position.

A second diverter may also be provided for blocking hydraulic fluid flow within the bypass manifold when a hardover steering condition is detected. Both the first and second diverters may comprise solenoid valves electrically connected to the controller when the controller is in the energized state.

The system may further include a rudder feedback device for sensing the position of the vessel's rudder and transmitting a feedback signal to the controller.

BRIEF DESCRIPTION OF THE DRAWINGS

In drawings which illustrate specific embodiments of the invention, but which should not be construed as restricting the spirit or scope of the invention in any way.

DETAILED DESCRIPTION OF THE PREFERRED EMBODIMENT

Figure 1:
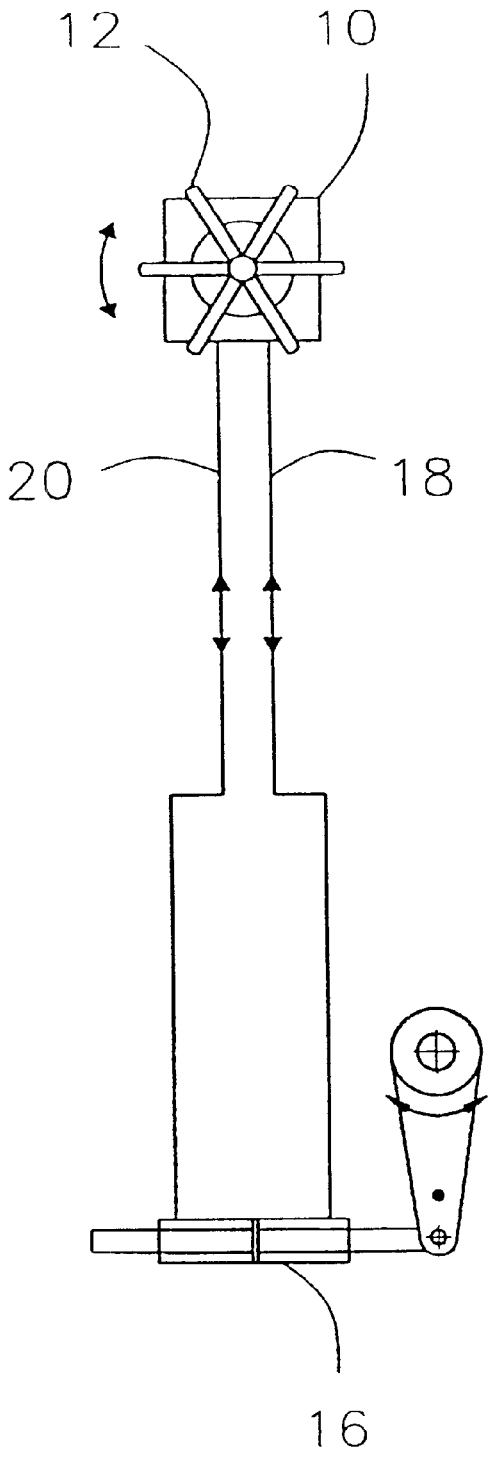
FIG. 1 is a schematic drawing showing a conventional manual hydraulic steering system comprising a helm pump for controlling the operation of a marine steering cylinder.

Many small marine vessels, such as commercial fishing boats, have manual hydraulic rather than power steering. As shown schematically in FIG. 1, such vessels typically have a helm pump 10 which is responsive to rotation of a steering wheel 12. When steering wheel 12 is rotated, helm pump 10 delivers hydraulic fluid to one or more hydraulic steering cylinders 16 through hydraulic fluid supply lines 18 and 20. The steering cylinder(s) control the position of the vessel's rudder via a tiller. For example, when steering wheel 12 is rotated in a clockwise direction, hydraulic fluid is pumped from helm pump 10 through first fluid supply line 18 to steering cylinder 16 which causes the vessel to turn in a starboard direction. Conversely, if steering wheel 12 is rotated counterclockwise, hydraulic fluid is pumped from helm pump 10 through second fluid supply line 20 to steering cylinder 16 to cause the vessel to turn in a port direction.

Figure 2:
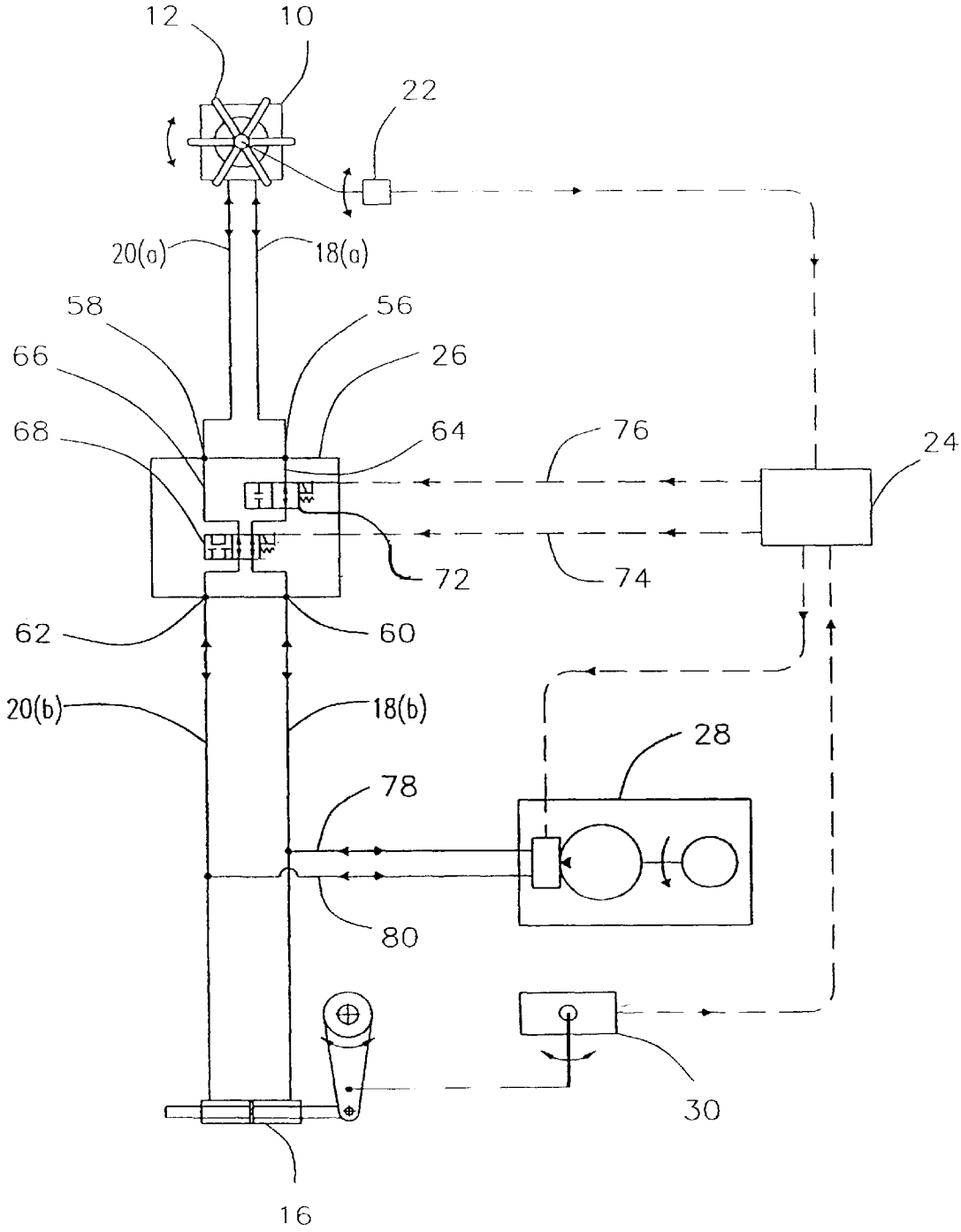
FIG. 2 is a schematic drawing showing alternative hydraulic and power steering systems using the modified helm pump of the present invention.

The present invention as shown schematically in FIG. 2 relates to a system for alternatively controlling the operation of steering cylinder 16 using either manual hydraulic steering or power steering. For example, the vessel may be ordinarily controlled using the power steering subsystem, but the manual steering subsystem engages automatically in the event of power failure. The power steering subsystem comprises a signal generating device, such as an incremental optical encoder 22, which is operatively coupled directly to helm pump 10 and is responsive to rotation of steering wheel 12. The power steering system further includes a programmable controller 24, such as an amplifier, capable of generating electronic control signals based on input received from encoder 22. As described in further detail below, the invention further includes a bypass manifold 26 and a pumpset 28 for interfacing the power steering subsystem to the conventional hydraulic fluid supply lines extending between helm pump 10 and steering cylinder 16. A rudder follow-up unit 30 is also provided for transmitting feed-back signals representative of the rudder position to amplifier 24.

Figure 3:
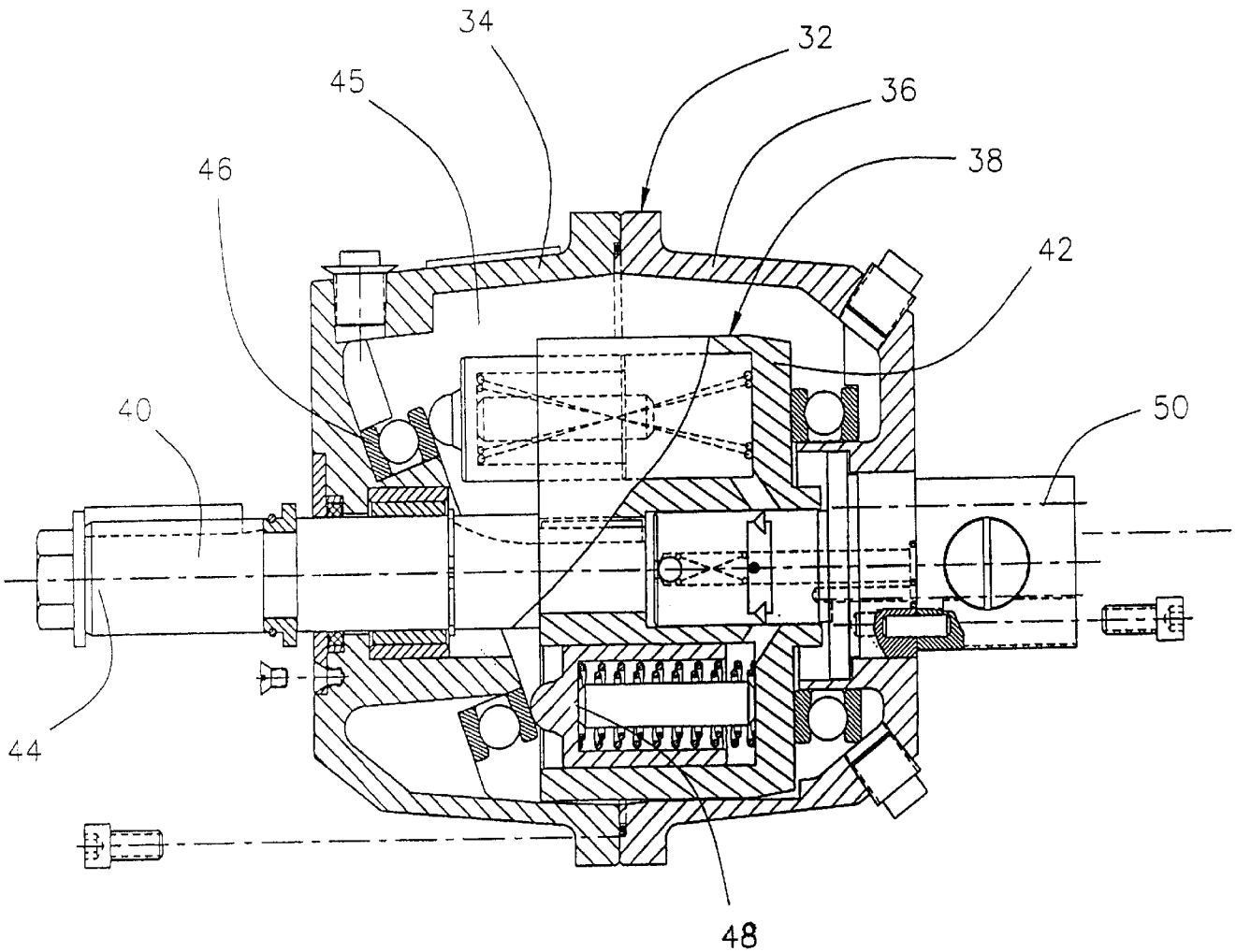
FIG. 3 is a cross-sectional view of a conventional marine helm pump having a single rotatable input shaft.

FIG. 3 illustrates a conventional marine helm pump 10 in cross-section. Helm pump 10 includes a housing 32 having connectable front and rear sections 34, 36. Housing 32 encloses a rotor/shaft subassembly 38. Subassembly 38 includes a single rotatable input shaft 40, which extends outwardly from housing front section 34, and a rotor 42. Shaft 40 has a first end 44 which is coupled to steering wheel 12.

Pump 10 typically includes an integral hydraulic fluid reservoir 45 surrounding rotor/shaft subassembly 38 although auxiliary fluid reservoirs are also known in the prior art. Turning steering wheel 12 and hence input shaft 40 causes an angled swash plate 46 to press upon a series of small pistons 48 which move axially within rotor 42. This in turn causes discharge of hydraulic fluid from pump 10 through a lock valve assembly 50 into one of the fluid supply lines 18, 20 depending upon the direction of rotation of wheel 12 (FIG. 1). The pumped hydraulic fluid is discharged from one of fluid lines 18, 20 into steering cylinder 16 to adjust the position of the vessel's rudder as discussed above. The hydraulic fluid displaced from cylinder 16 is returned to pump 10 through the other of the fluid lines 18, 20 to complete the closed hydraulic circuit. The same process occurs if wheel 12 is turned in the other direction except that the flow of hydraulic fluid is reversed. When rotation of wheel 12 is stopped, lock valve assembly 50 prevents return of hydraulic fluid into helm pump 10, thereby isolating steering wheel 12 from the rudder loads.

Figure 4:
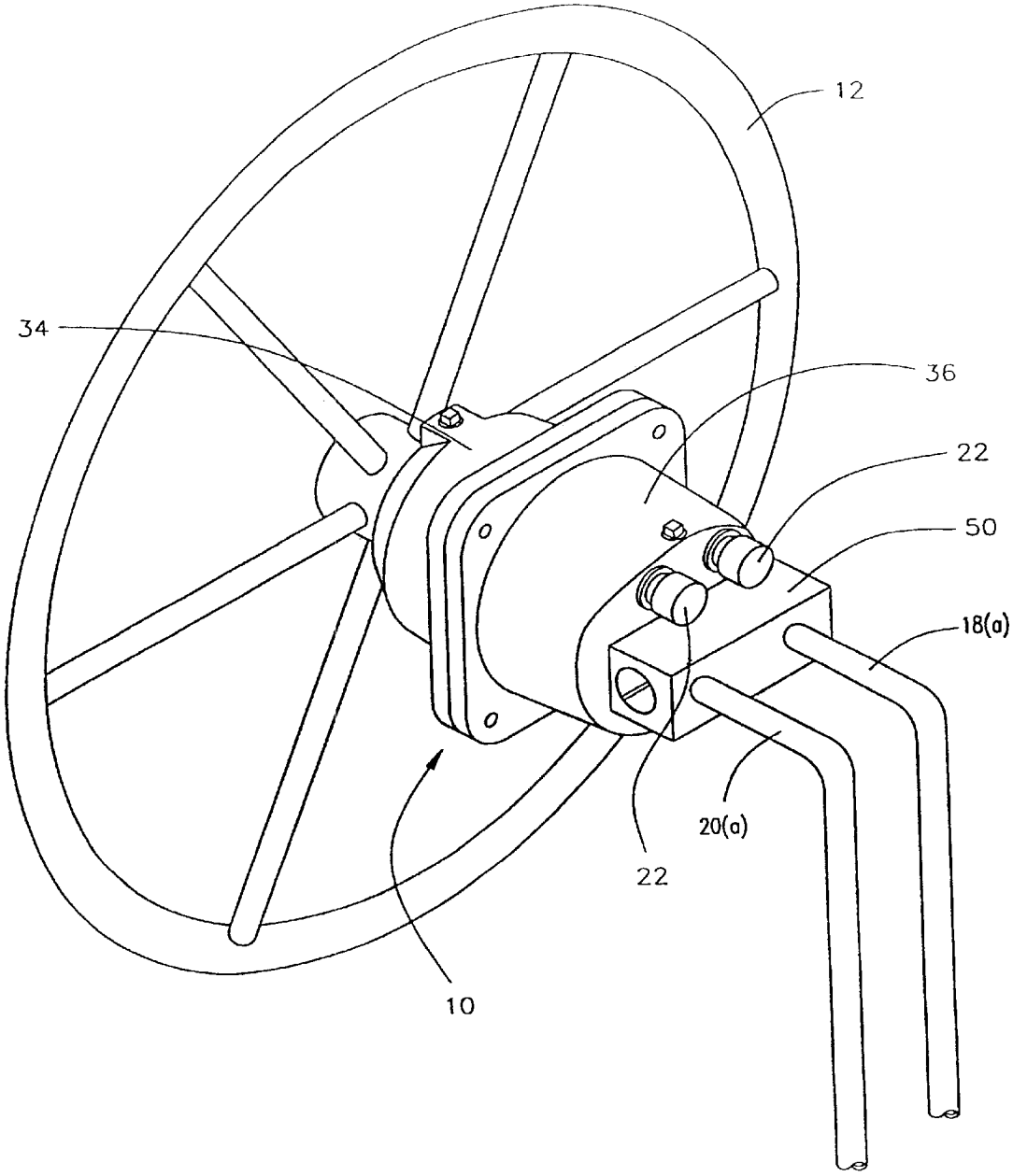
FIG. 4 is perspective view of first embodiment of the invention comprising dual optical encoders coupled to the helm pump input shaft by means of a spur gear.

FIG. 4 illustrates a helm pump 10 modified in accordance with a first embodiment of the invention. In this embodiment a pair of encoders 22 are mounted on rear section 36 of housing 32 proximate lock valve assembly 50 (although a single encoder 22 could also be employed). In the illustrated embodiment two functionally independent encoders 22 are provided for redundancy purposes. Each encoder 22 may consist of any suitable instrument for generating an electronic signal representative of rotary movement of pump input shaft 40, such as an incremental optical encoder, hall effect device (magnetic field sensor) or a potentiometer.

Figure 5:
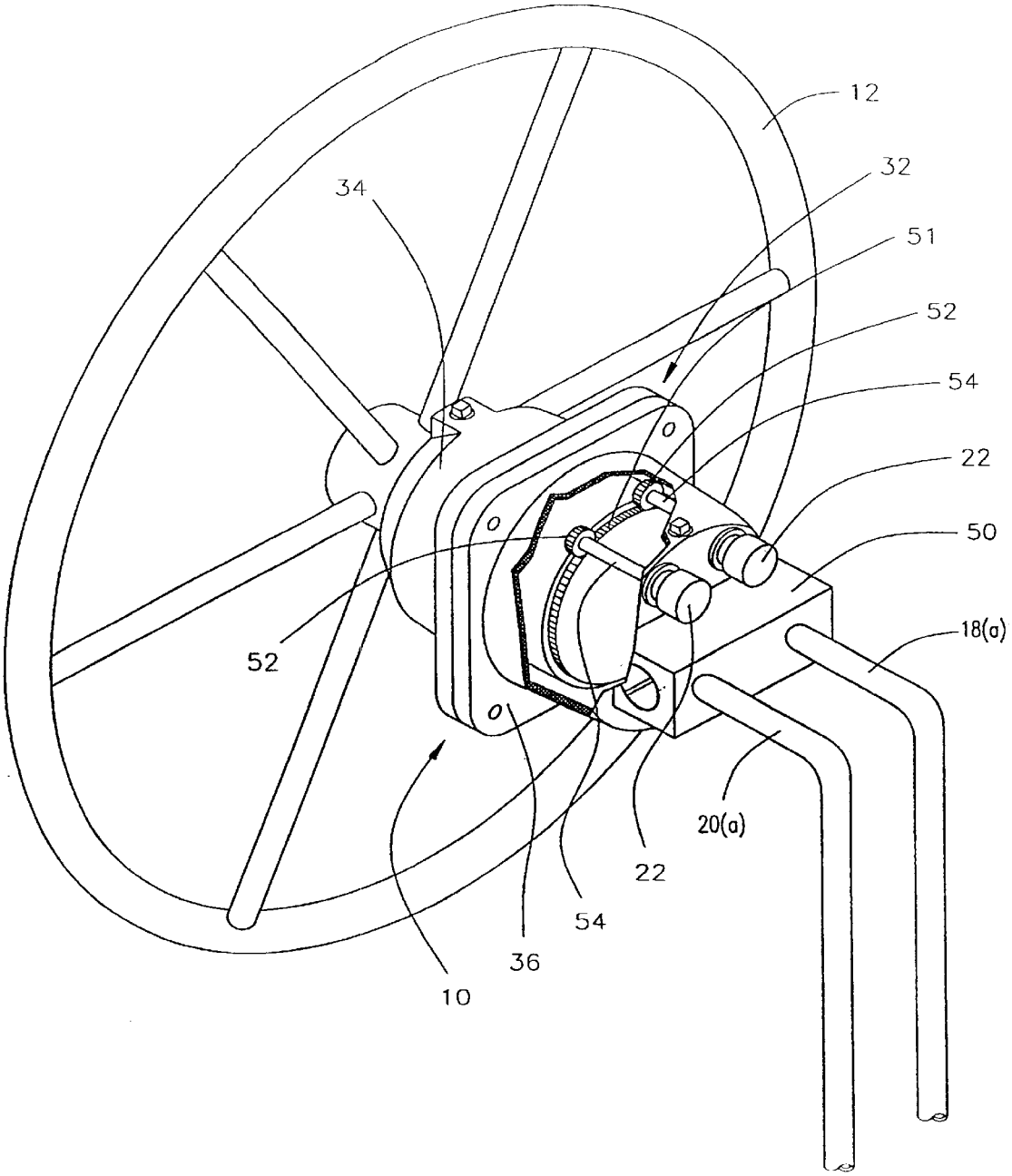
FIG. 5 is cut-away view of the embodiment of FIG. 4 showing the spur gear arrangement.
Figure 6A:
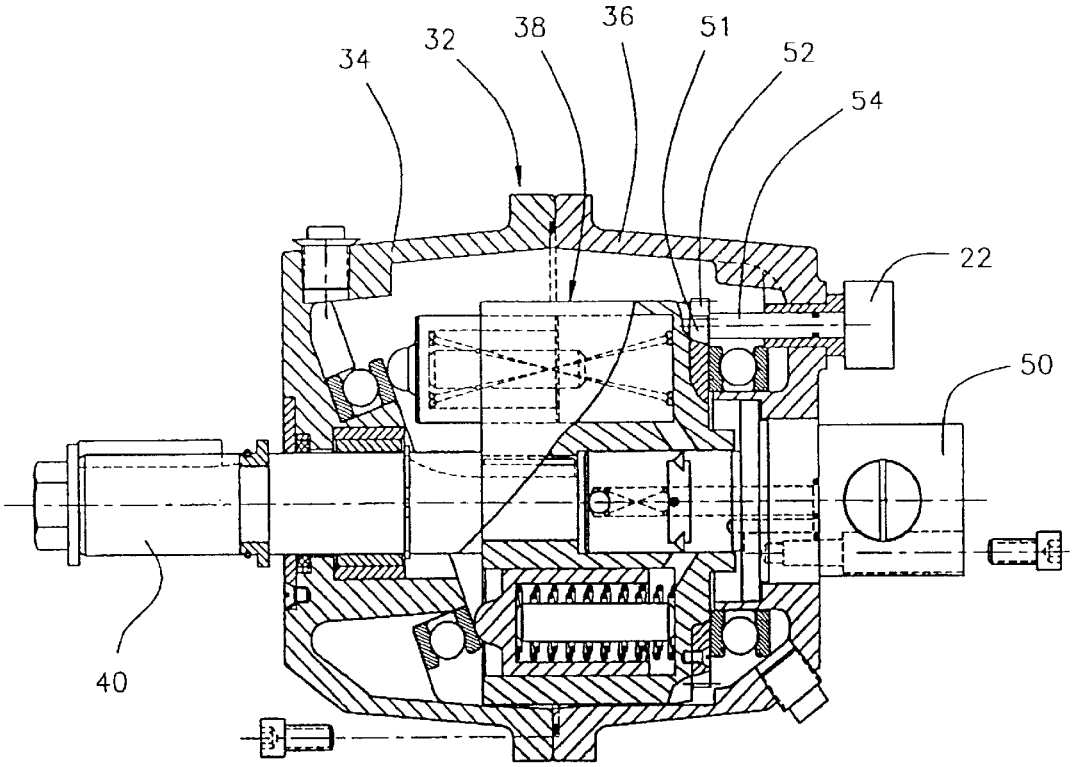
FIG. 6*a* is a cross-sectional view of the embodiment of FIG. 4.
Figure 6B:
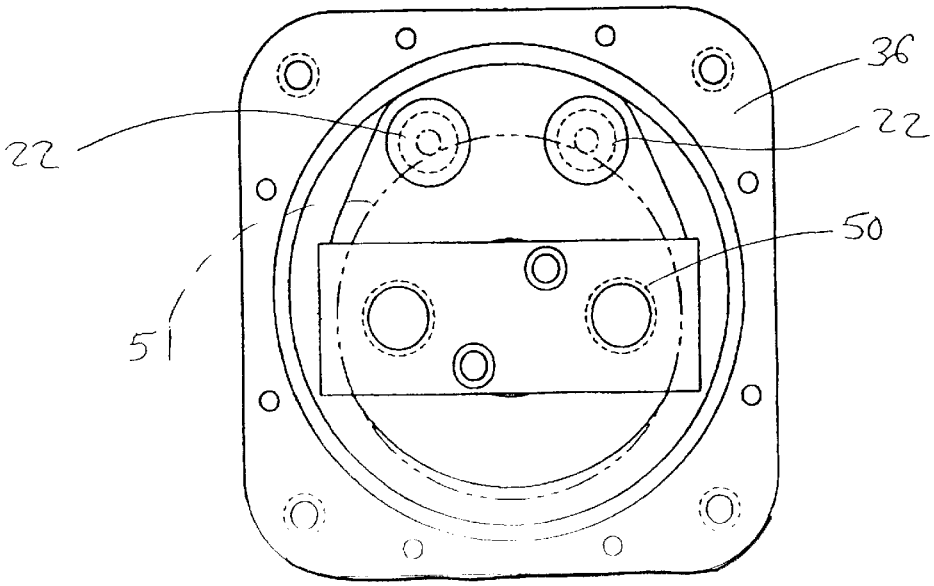
FIG. 6*b* is an end elevational view of the embodiment of FIG. 4.
Figure 7:
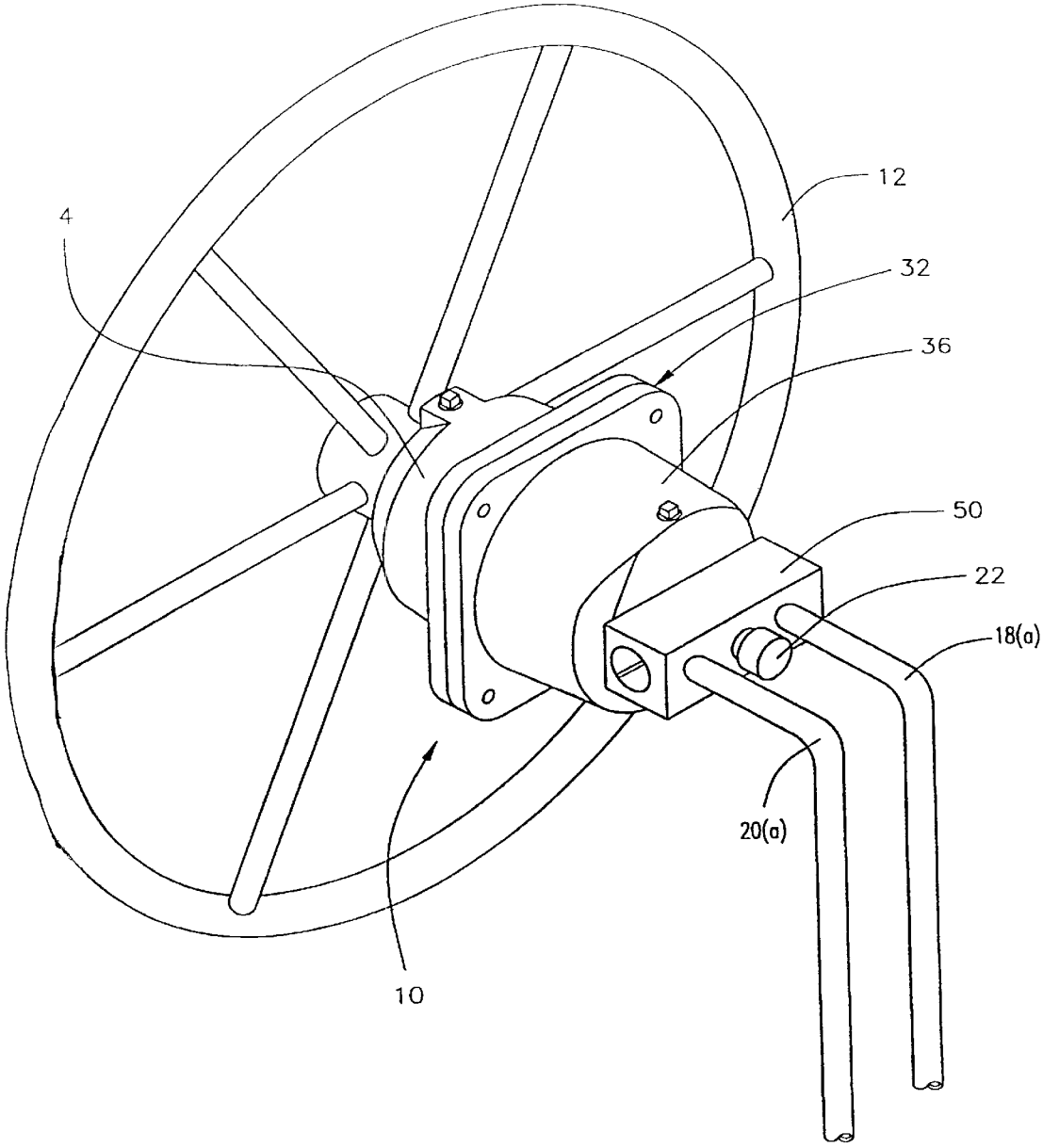
FIG. 7 is a perspective view of an alternative embodiment of the invention comprising an optical encoder coupled directly to an end portion of the helm pump input shaft distal from the steering wheel.

As shown best in FIG. 5, modified helm pump 10 includes a spur gear 51 which is coupled to input shaft 40 and is rotatable therewith. Each rotary encoder 22 is coupled to spur gear 51 by means of a smaller encoder spur gear 52 which is mounted at the end of a connecting shaft 54. Accordingly, rotation of input shaft 40 is translated to encoder 22 by means of the mechanical engagement of spur gears 51, 52. Each encoder 22 generates an electronic signal representative of the rotational change in position of shaft 40 as steering wheel 12 is turned. For example, encoder 22 may comprise an optical encoder coupled to a counter which produces an up count for a clockwise rotation of steering wheel 12 and a down count for a counterclockwise rotation of steering wheel 12. The size of the count in either direction represents the magnitude of the steering adjustment.

In use, the electronic steering signal generated by encoder 22 is transmitted to controller 24 for further processing (FIG. 2). As indicated above, controller 24 may consist of a programmable amplifier which is connected to a source of electric power. Controller 24 transmits a control signal corresponding to the steering signal input from encoder 22 to the electro-hydraulic interface of pumpset 28. Pumpset 28 in turn provides hydraulic fluid to steering cylinder 16 to provide the desired rudder motion necessary to steer the vessel as described further below.

When the power steering subsystem described above is activated, the manual hydraulic steering subsystem is disabled. This is accomplished by bypass manifold 26 which is disposed between helm pump 10 and steering cylinder 16 (FIG. 2). In the applicant's steering system each of the hydraulic fluid lines extending between helm pump 10 and cylinder 16 is divided into two separate segments, namely a first segment 18(*a*) or 20(*a*) extending between pump 10 and manifold 26 and a second segment 18(*b*) or 20(*b*) extending between manifold 26 and cylinder 16. Bypass manifold 26 includes a first inlet port 56 for receiving hydraulic fluid from fluid supply line 18(*a*) and a second inlet port 58 for receiving hydraulic fluid from fluid supply line 20(*a*). Manifold 26 also includes a first fluid outlet port 60 in communication with fluid supply line 18(*b*) and a second outlet port 62 in communication with fluid supply line 20(*b*).

A pair of internal conduits 64, 66 extend within manifold 26. Conduit 64 connects first inlet port 56 and first outlet port 60; conduit 66 similarly connects second inlet port 58 and second outlet port 62. As described further below, conduits 64, 66 enable the flow of hydraulic fluid from pump 10 through manifold 26 directly to steering cylinder 16 in the event of a power failure.

When the power steering subsystem is operational, a diverter valve 68 diverts hydraulic fluid flowing through one of the internal conduits 64, 66 to the other of the internal conduits 64, 66. The diverted fluid is recirculated back to helm pump 10 in a closed loop fashion. Diverter valve 68 may consist, for example, of one or a pair of solenoid cartridge valves which are connectable to a conventional power source. As shown in FIG. 2, valve 68 may receive an output current from controller 24 through cable 74. When valve 68 is energized valve plunger(s) block fluid flow toward outlets 60, 62, thereby blocking fluid flow between manifold 26 and steering cylinder 16.

A second valve 72 is also mounted within manifold 26 to regulate fluid flow through one of internal conduits 64 and 66 when the power steering subsystem is operational. Valve 72 may also constitute a solenoid cartridge valve which is ordinarily in an open position to permit fluid flow. As shown in FIG. 2, valve 72 receives electrical input from controller 24 through cable 76. Controller 24 is configured to adjust valve 72 to a closed position to lock steering wheel 12 when a hardover steering condition is detected (i.e. depending upon its position, valve 72 will either permit or not permit hydraulic fluid flow). Encoder 22 and controller 24 may be calibrated so that a predetermined number of rotations of steering wheel 12 are required to go from hardover to hardover when power is applied. Controller 24 is programmable so that the hardover settings may be easily adjusted to suit, for example, prevailing water conditions or user preferences. In this regard, the present invention could be interfaced with a weather-adapted autopilot. As indicated above, the exact rudder position may be detected by rudder follow-up unit 30 which transmits feedback signals to controller 24.

When the power steering subsystem is operational, controller 24 sends an output current to one or more directional control valves on pumpset 28 which in turn regulate the flow of hydraulic fluid from pumpset 28 into fluid supply lines 78 and 80. Lines 78 and 80 are connectable to supply lines 18(*b*) and 20(*b*) respectively to deliver hydraulic fluid to cylinder 16 to effect the desired change in rudder position.

In the event of a power failure, both valves 68, 72 within manifold 26 are deenergized and move to open positions. As discussed above, this permits hydraulic fluid to be shunted directly through manifold 26 through internal conduits 64, 66. The pilot will feel more resistance to rotation of steering wheel 12 as the vessel automatically switches from power to manual steering. The vessel may be steered from the helm until the power failure is remedied; thus it is not necessary for the pilot to relay instructions to remote operators in the steering flat in order to effectively control the vessel.

Figure 8:
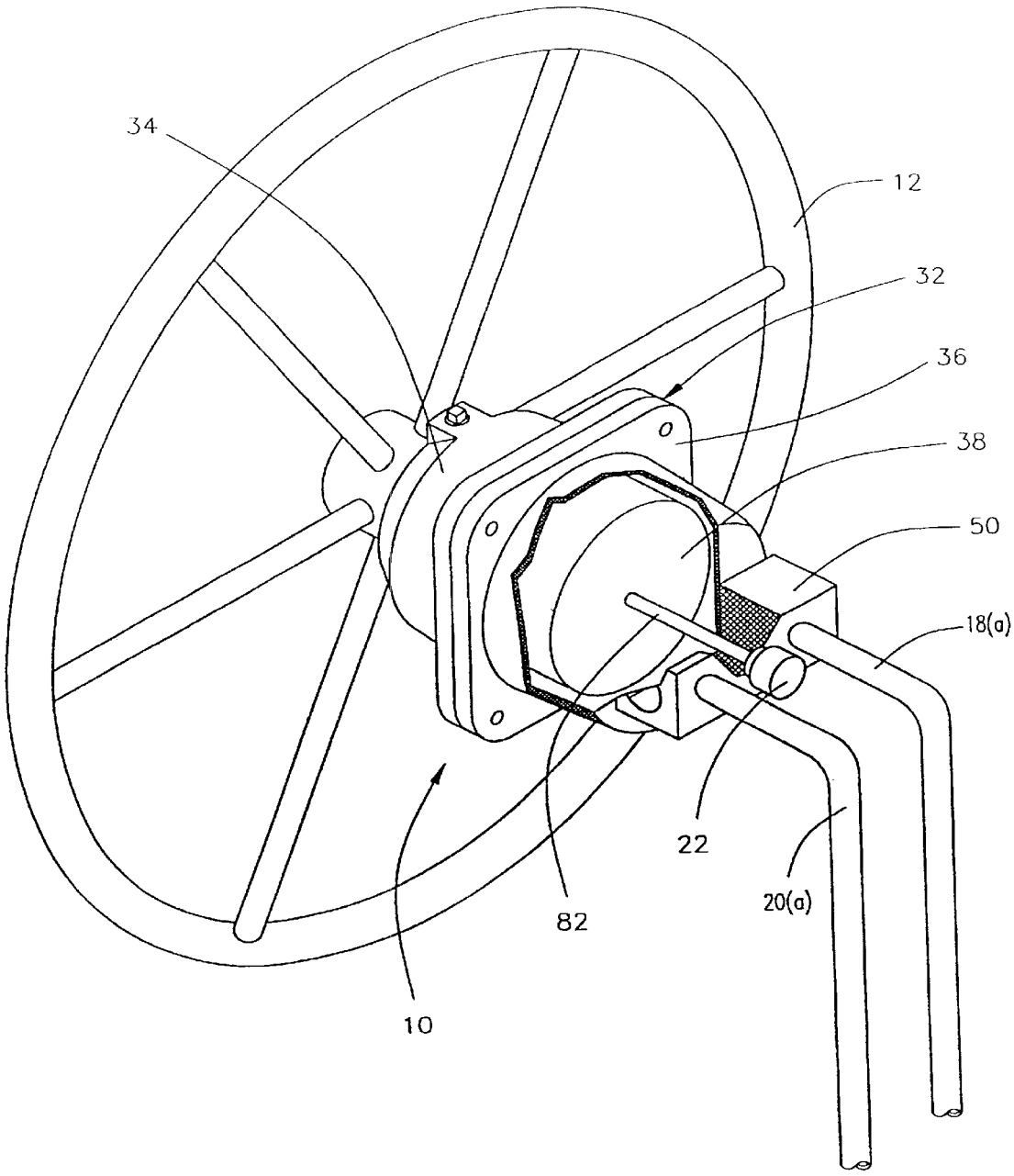
FIG. 8 is cut-away view of the embodiment of FIG. 7.
Figure 9A:
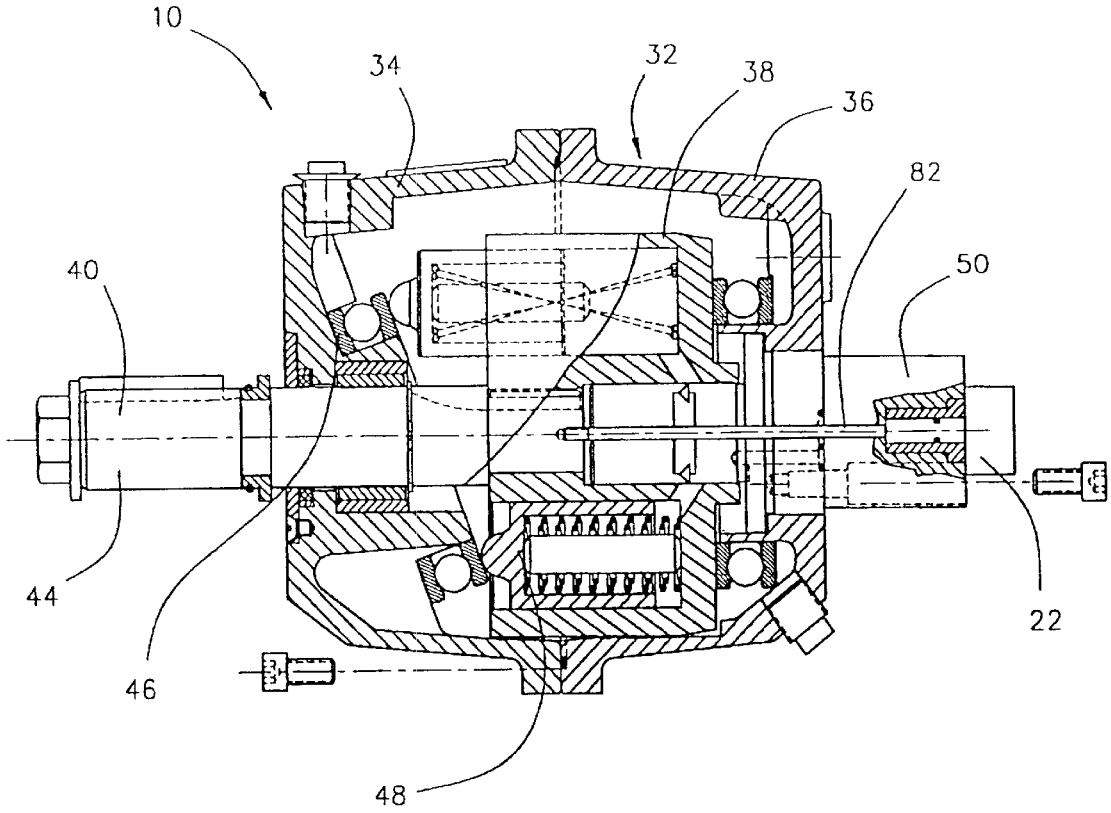
FIG. 9*a* is a cross-sectional view of the embodiment of FIG. 7.
Figure 9B:
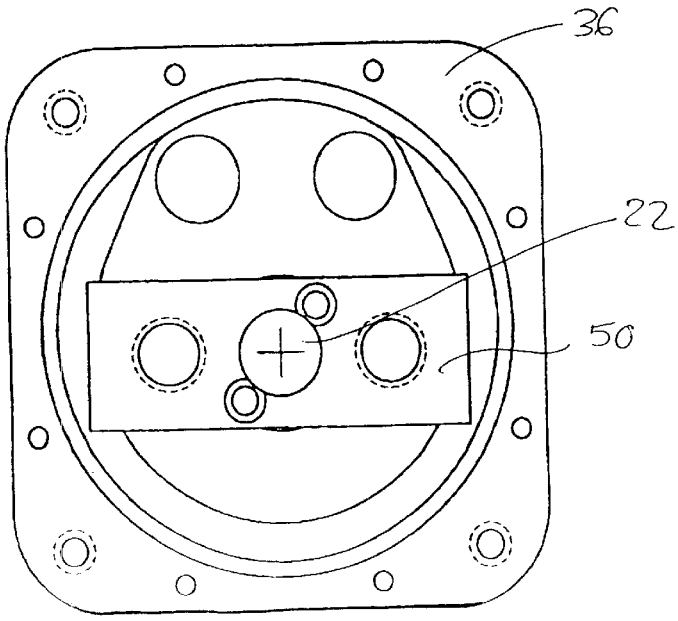
FIG. 9*b* is an end elevational view of the embodiment of FIG. 7.

FIGS. 7–9*b* illustrate an alternative embodiment of the invention which utilizes an alternative means for coupling rotary encoder 22 to input shaft 40. In this embodiment encoder 22 is shaft-driven. As shown in FIG. 8, encoder 22 is coupled to the rotatable rotor/shaft subassembly 38 by means of a connecting shaft 82. As input shaft 40 rotates, rotational movement is translated to connecting shaft 82 and is detected by encoder 22 (FIG. 9*a*). The steering signal is transmitted from encoder 22 to controller 24 and is processed as described above.

Figure 10:
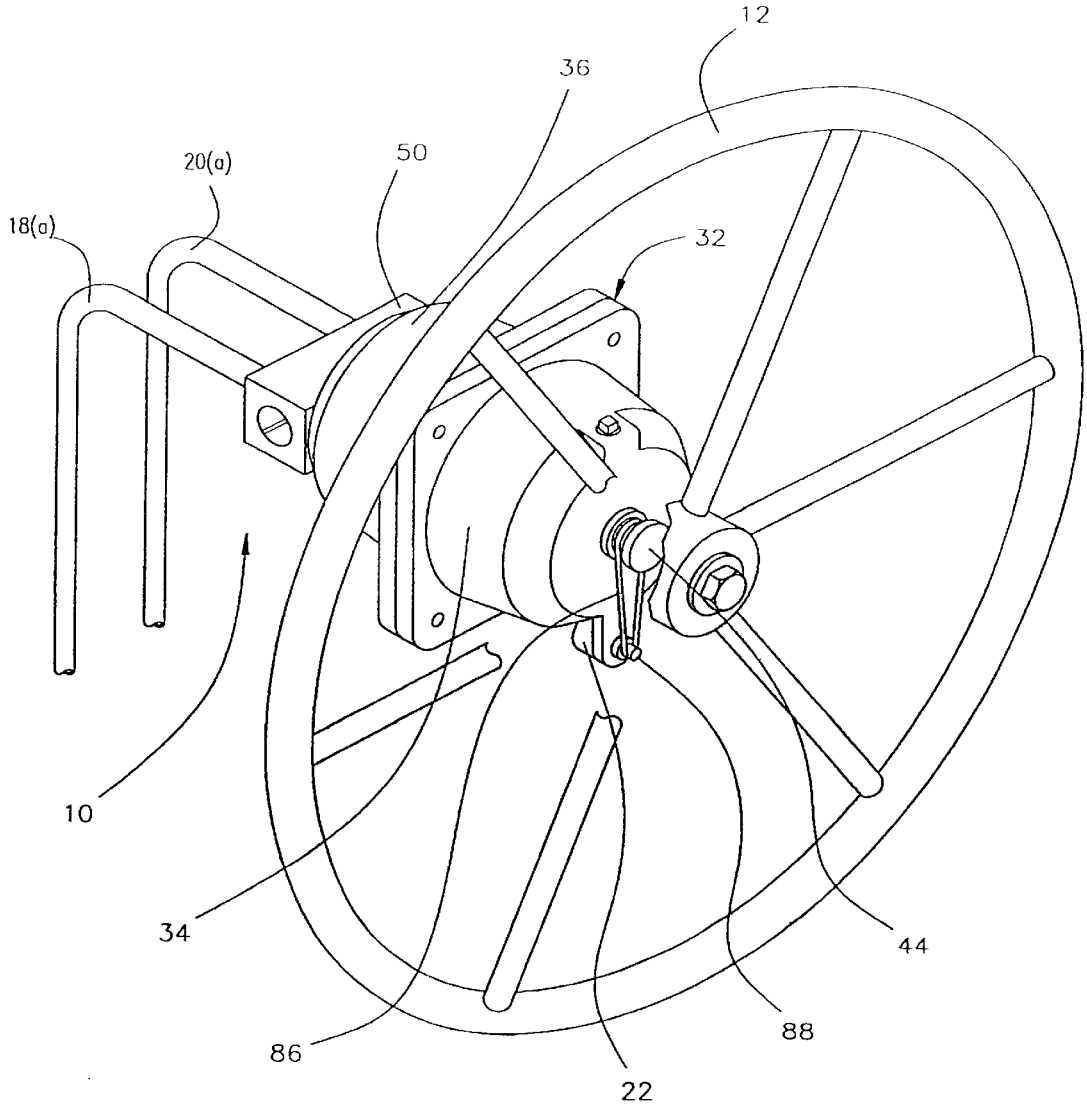
FIG. 10 is a perspective, cut-away view of further alternative embodiment of the invention comprising an optical encoder coupled directly to an end portion of the helm pump input shaft proximate the steering wheel by means of a mechanical belt assembly.
Figure 11A:
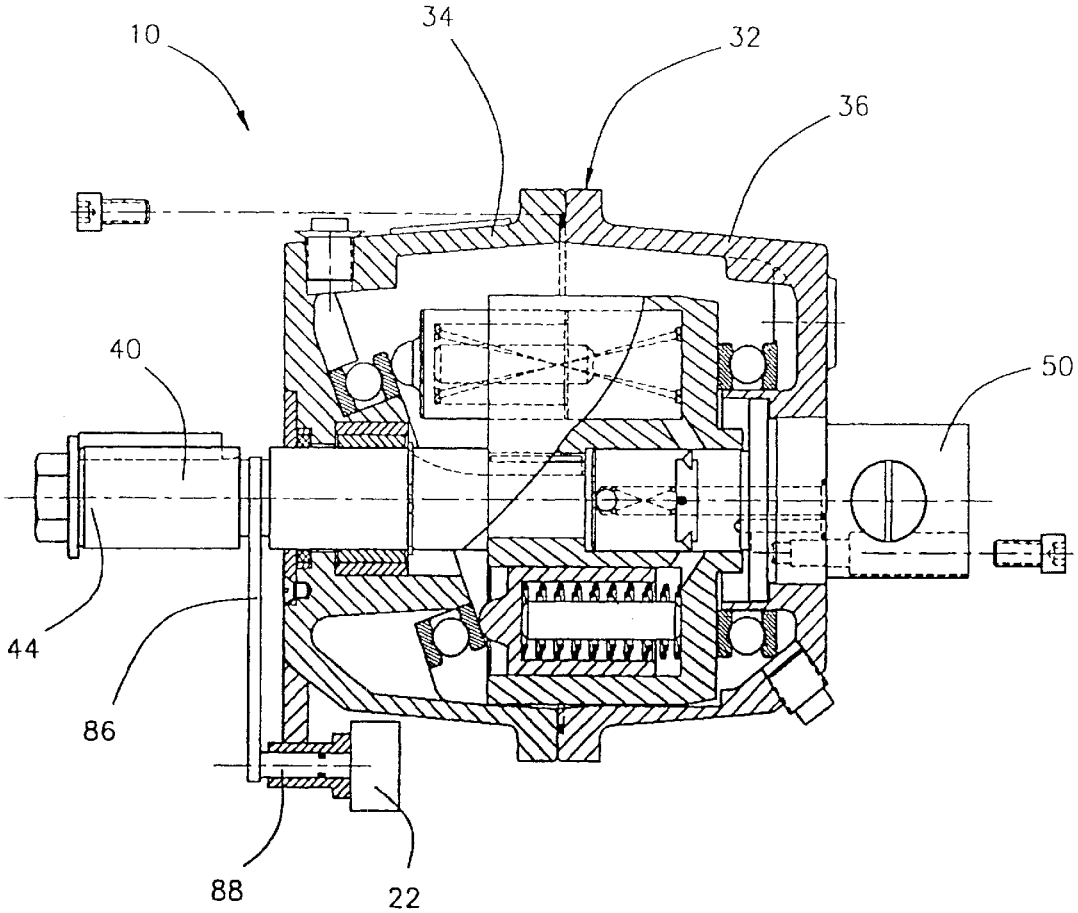
FIG. 11*a* is a cross-sectional view of the embodiment of FIG. 10.
Figure 11B:
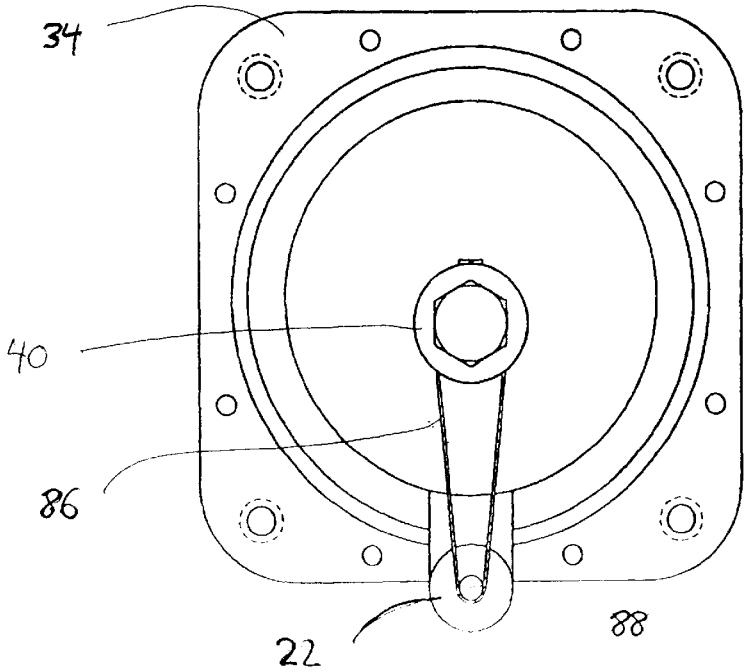
FIG. 11*b* is an end elevational view of the embodiment of FIG. 10.

FIGS. 10–11*b* illustrate a further alternative embodiment of the invention which utilizes yet another alternative means for coupling encoder 22 to input shaft 40. In this embodiment encoder 22 is coupled to a forward portion of shaft 40 proximate steering wheel 12 by means of a belt assembly 84. Assembly 84 includes an endless belt 86 for translating rotational movement of input shaft 40 to a short connecting shaft 88 mounted on housing front section 34 and coupled to encoder 22. Steering signals generated by encoder 22 are transmitted to controller 24 and processed as in the other embodiments of the invention described above.

An important feature of the invention is that encoders 22 detect incremental changes in the position of steering wheel input shaft 40 rather than an absolute steering position. For example, in the event that the steering system switches from power steering to manual steering as described above and then back to power steering, rudder 16 will not automatically revert to a setting corresponding to the absolute position of wheel 12 when power is applied. Rather, rudder 16 will remain at the same setting as when the power steering system was reactivated until such time as wheel 12 and hence input shaft 40 is further turned in the automatic steering mode. Encoder 22 then detects the incremental change in position of wheel 12 by counting pulses as described above to adjust the position of rudder 16 and hence the steering course of the vessel.

As will be apparent to a person skilled in the art, other equivalent means for mechanically coupling an encoder to helm pump input shaft 40 may be envisaged. Many alterations and modifications are possible in the practice of this invention without departing from the spirit or scope thereof. Accordingly, the scope of the invention is to be construed in accordance with the substance defined by the following claims.

What is claimed is:

1. A marine helm pump assembly comprising:

(a) a helm pump for actuating the flow of hydraulic fluid, said helm pump comprising (i) a chamber for holding a supply of said hydraulic fluid;

(ii) a single rotatable input shaft connectable to a steering wheel; and (iii) a first fluid port and a second fluid port in communication with said chamber for enabling flow of said hydraulic fluid into and out of said helm pump in response to changes in position of said input shaft; and (d) a first signal generator mounted on said helm pump and operatively coupled to said input shaft for producing digital steering signals representative of changes in position of said input shaft.

2. The helm pump assembly of claim 1, wherein said first signal generator is mechanically connected to said input shaft.

3. The helm pump assembly of claim 2, wherein said signal generator comprises an incremental encoder.

4. The helm pump assembly of claim 3, wherein said encoder is mounted directly on said input shaft.

5. The helm pump assembly of claim 3, further comprising a spur gear for coupling said encoder to said input shaft.

6. The helm pump assembly of claim 3, further comprising a belt drive for coupling said encoder to said input shaft.

7. The helm pump assembly of claim 1, further comprising a second signal generator mounted on said helm pump and operatively coupled to said input shaft for producing digital steering signals representative of changes in position of said input shaft.

8. The helm pump assembly of claim 3, wherein said encoder is an optical encoder.

9. The helm pump assembly of claim 3, wherein said encoder is a hall effect device.

10. A steering system for a marine vessel comprising:

(a) a helm pump having a primary hydraulic fluid supply and a rotatable input shaft, said input shaft being operatively connected to a steering actuator;

(b) hydraulic fluid supply lines connected to said helm pump, wherein said helm pump pumps hydraulic fluid from said primary hydraulic fluid supply into at least one of said fluid supply lines in response to changes in position of said input shaft, said fluid supply lines being connectable to a hydraulic steering cylinder for controlling the position of the vessel's rudder; and (c) a first signal generator mounted on said helm pump and operatively coupled to said input shaft for producing digital steering signals representative of changes in position of said input shaft.

11. The steering system of claim 10, wherein said steering assembly further comprises a bypass manifold in fluid communication with said helm pump and said steering cylinder and located therebetween, wherein said bypass manifold is adjustable between a first position permitting flow of hydraulic fluid between said helm pump and said steering cylinder and a second position blocking flow of hydraulic fluid between said helm pump and said steering cylinder.

12. The steering system of claim 11, further comprising:

(a) a programmable controller connectable to a electric power source and adjustable between energized and deenergized states, said controller receiving input from said signal generator in said energized state; and (b) a pumpset having a secondary hydraulic fluid supply connectable to said steering cylinder, wherein said pumpset is adjustable between a third position enabling flow of hydraulic fluid between said pumpset and said steering cylinder and a fourth position blocking flow of hydraulic fluid between said pumpset and said steering cylinder, wherein in said energized state said controller maintains said bypass manifold in said second position and said pumpset in third position to enable electric steering of said vessel, and in said deenergized state said bypass manifold is automatically adjusted to said first position and said pumpset is automatically adjusted to said fourth position to enable manual hydraulic steering of said vessel.

13. The steering system of claim 12, wherein said controller transmits control signals to said pumpset in said energized state responsive to said digital steering signals received from said signal generating device.

14. The steering system of claim 13, wherein said bypass manifold further comprises:

(a) at least one inlet port for receiving hydraulic fluid from said helm pump;

(b) at least one outlet port for enabling delivery of hydraulic fluid from said manifold to said cylinder;

(c) a first conduit connecting said inlet port and said outlet port; and (d) a diverter for selectively diverting hydraulic fluid from said first conduit to said primary fluid supply when said manifold is in said second position.

15. The steering system of claim 14, wherein said diverter is a solenoid valve operatively coupled to said controller.

16. The steering system of claim 13, wherein said hydraulic fluid supply lines comprise a first hydraulic fluid supply line and a second hydraulic fluid supply line, and wherein said bypass manifold further comprises:

(a) a first fluid port for receiving hydraulic fluid from said first hydraulic fluid supply line and a second fluid port for receiving hydraulic fluid from said second hydraulic fluid supply line;

(b) third and fourth fluid ports for enabling delivery of hydraulic fluid from said manifold to said cylinder;

(c) a first conduit connecting said first fluid port and said third fluid port;

(d) a second conduit connecting said second fluid port and said fourth fluid port;

(e) a first diverter for selectively blocking said third and fourth fluid ports and for diverting hydraulic fluid from said first conduit to said second conduit when said manifold in said second position, thereby enabling recirculation of said hydraulic fluid from said manifold to said primary hydraulic fluid supply.

17. The steering system of claim 16, wherein said system further comprises a second diverter positionable in one of said first or second conduits for blocking hydraulic fluid flow within said manifold when a hardover control signal is received from said controller in said energized state.

18. The steering system of claim 16, wherein said first diverter is a solenoid cartridge valve.

19. The steering system of claim 17, wherein said second diverter is a solenoid cartridge valve.

20. The steering system of claim 10, wherein said signal generating device is an optical encoder mechanically coupled to said input shaft.

21. The steering system of claim 20, further comprising a spur gear mounted within said helm pump for coupling said optical encoder to said input shaft.

22. The steering system of claim 20, further comprising a belt assembly for coupling said optical encoder to said input shaft.

23. The steering system of claim 20, wherein said optical encoder is coupled directly to an end portion of said input shaft.

24. The steering system of claim 10, further comprising a rudder feedback device for sensing the position of the vessel's rudder and transmitting a feedback signal to said controller.

25. The steering system of claim 10, wherein said signal generating device is a rotary encoder mechanically coupled to said input shaft.

* * * * *